United States Patent [19]

Stahlecker

[11] 4,089,155

[45] May 16, 1978

[54] OPEN-END SPINNING MACHINE WITH FACILITIES AND METHOD FOR THE SIMULTANEOUS PIECING OF ALL SPINNING UNITS

[75] Inventor: Fritz Stahlecker, Josef-Neidhart-Strasse 18, 7341 Bad Ueberkingen, Germany

[73] Assignees: Fritz Stahlecker; Hans Stahlecker, both of Germany

[21] Appl. No.: 746,173

[22] Filed: Nov. 30, 1976

[30] Foreign Application Priority Data

Dec. 6, 1975 Germany ..... 2555058

[51] Int. Cl.[2] ..... D01H 15/00

[52] U.S. Cl. ..... 57/34 R; 57/58.89

[58] Field of Search ..... 57/34 R, 58.89

[56] References Cited

U.S. PATENT DOCUMENTS

| | | | |
|---|---|---|---|
| 3,695,017 | 10/1972 | Hori et al. | 57/34 R |
| 3,810,352 | 5/1974 | Mujazaki et al. | 57/34 R |
| 3,924,393 | 12/1975 | Stahlecker et al. | 57/34 R |
| 3,924,394 | 12/1975 | Stahlecker et al. | 57/34 R |
| 3,925,975 | 12/1975 | Stahlecker et al. | 57/34 R |
| 3,987,610 | 10/1976 | Stahlecker et al. | 57/34 R |

*Primary Examiner*—Richard C. Queisser
*Assistant Examiner*—Charles Gorenstein
*Attorney, Agent, or Firm*—Craig & Antonelli

[57] ABSTRACT

Open-end spinning machine apparatus is provided for accommodating sequential preparation of a plurality of spinning units of a spinning machine so that they may thereafter be simultaneously started up by common drive means with simultaneous thread piecing operations taking place at each of the spinning units. The piecing preparation apparatus includes one or more mobile units having cleaning apparatus for cleaning the spinning units and apparatus for preparing and transferring a thread end from a bobbin at each of the spinning units to the respective spinning rotors. Certain embodiments of the invention utilize a mobile piecing device which is operable to preform piecing operations at individual spinning units during normal operation of the spinning machine, to also carry the equipment for preparing the plurality of individual spinning units when the machine is completely shut down.

33 Claims, 7 Drawing Figures

FIG. 6
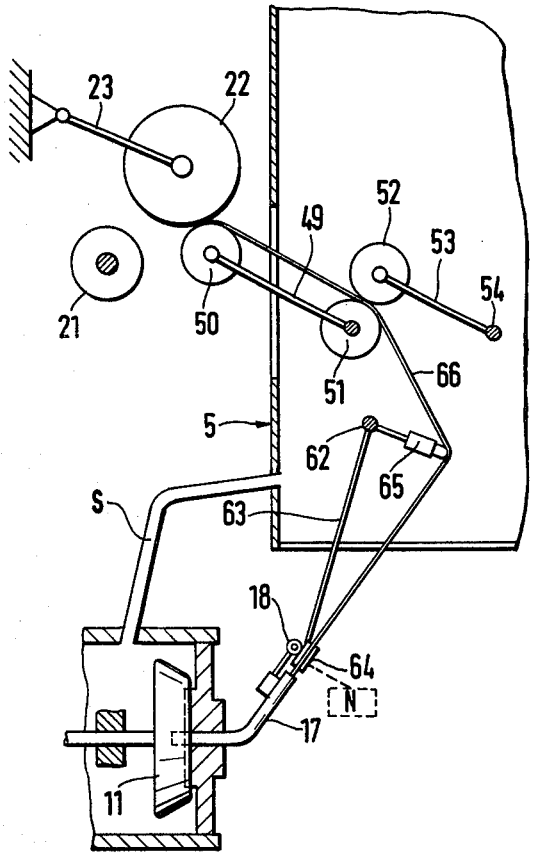
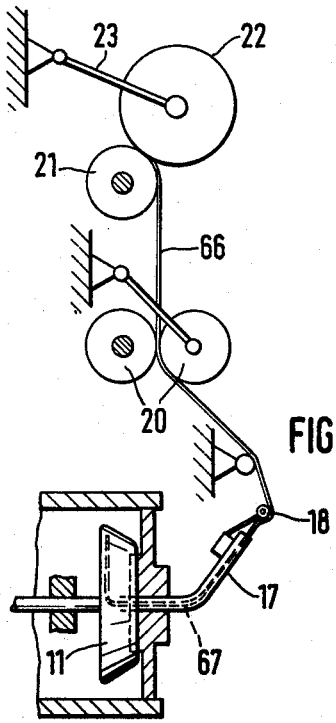
FIG. 7

OPEN-END SPINNING MACHINE WITH FACILITIES AND METHOD FOR THE SIMULTANEOUS PIECING OF ALL SPINNING UNITS

BACKGROUND OF THE INVENTION

This invention relates to an open-end spinning machine with facilities for the simultaneous piecing of thread at all spinning units and with centrally controlled drive mechanisms for the sliver feeding devices, for the sliver opening devices, for the spinning rotors, for the devices to take off the spun threads and to wind same onto bobbins, and for devices to produce a vacuum in housings surrounding the spinning rotors.

It has been contemplated to provide a so-called stop-start program to realize a combined piecing of all spinning units in open-end spinning machines. In this process, the shutting off of the spinning machine is conducted in a specific manner so that the thread, which breaks when the open-end spinning machine is turned off, does not leave the zone of the thread take-off duct so that the thread can be returned into the spinning rotor. Besides, a thread reserve is formed which is opened up during the startup of the open-end spinning machine so that the thread is sucked back into the spinning rotor. In this method, the final thread end produced upon the arrest of the machine has an overtwisted taper. During the startup of the machine, this taper of the threads results in poor piecing locations, the so-called corkscrews. This flaw in the yarn is in most cases made even worse because the thread end is once more overtwisted during the piecing operation. Under practical conditions, the observations is made in open-end spinning machines operating according to such methods that the piecing step is unsuccessful in a relatively high percentage of the spinning units so that an operator must piece the thread manually subsequently at such locations. This causes considerable difficulties in case the open-end spinning machine runs at relatively high rotor speeds, since then the piecing operation in principle is substantially more difficult.

Moveable piecing devices have likewise become known which are moved along an open-end spinning machine, executing an automatic piecing operation at the individual spinning stations. Such mobile piecing devices are intended particularly for eliminating the thread breaks occurring during operation at individual spinning stations. In a conventional type of construction (DOS [German Unexamined Laid-Open Application] No. 2,350,840) a cleaning step precedes the piecing operation proper, by which all essential parts of the respective spinning unit are subjected to a cleaning action. The reason for this is that it has been found that the occurrence of contaminations of the spinning unit and especially dirt in the spinning rotor is a cause for most of the thread break and also for flaws in the yarn. For this reason, the conventional type of structure provides furthermore to arbitrarily cause a thread break after a certain operating period and then to execute a cleaning and piecing operation. This makes it possible to ensure an extensively uniform yarn quality. It is possible to utilize such a mobile piecing device in order to start up an open-end spinning machine after it has come to a standstill. However, it should be kept in mind that in such a case a relatively large amount of time is consumed until all of the spinning units of the open-end spinning machine have commenced operation. This piecing time becomes shorter if several mobile piecing devices are present. However, this results in increased expenditure, inasmuch as the piecing devices are not cheap.

The invention is based on the problem of fashioning an open-end spinning machine of the type described hereinabove so that a combined piecing of all spinning units can be executed, wherein a maximally high quota of success is provided without having to incur excessive expenditures from a manufacturing viewpoint for each spinning unit.

This problem is solved by providing a program control for the drive mechanisms at least for the startup operation, thus controlling the instants at which the drive mechanisms are placed in operation; and by arranging, for the preparation of all spinning units for the combined piecing step, at least one servicing device movable to the individual spinning units which is equipped with means for seizing the threads and for returning same to the spinning rotors.

By means of this construction, a combined piecing operation becomes possible without having to design the individual spinning units in a special way or having to include therein additional operating elements which would increase the manufacturing expenditure. Yet, a rapid and safe piecing operation is thus obtained, since the mobile servicing device can readily be constructed so that it operates very exactly. Since the elements used in this mobile servicing device need to be present only once (no duplicates being required), a relatively high expenditure for same is worthwhile. The servicing device can execute the preparation work after the open-end spinning machine has been arrested or before it is placed in operation, so that the time necessary for the preparation of the spinning units is not lost in the form of operating time.

In a further development of the invention, the provision is made to equip the servicing device or devices with means for cutting the threads to a certain length and for preparing the thread ends. It is thereby made possible to further enhance the successful operation of the combined piecing method and to produce thread piecing places of high quality. The less satisfactory end of the thread produced before the open-end spinning machine was turned off is not utilized for the piecing operation, since this could impair the success.

In a further embodiment of the invention, the servicing device or devices have means for feeding the thread ends to thread take-off ducts of the spinning units. A return of the thread end into the spinning rotors is then readily possible if, during the operation of the servicing device, the vacuum generation of the open-end spinning machine has been maintained. However, if the open-end spinning machine is to be turned off entirely, then another embodiment of this invention provides that the servicing device includes a suction nozzle which can be selectively associated with connections of the housings of the spinning units surrounding the spinning rotors. In this case, the servicing device proper generates the vacuum, which latter is utilized for sucking the thread ends into the spinning rotors. For the same purpose, another embodiment of the invention provides that the servicing device or devices are equipped with an injection nozzle which can be associated with the thread take-off ducts including the threads. In this connection, the thread end is blown into the zone of the spinning rotors, so that here again the open-end spinning machine can remain in the turned-off condition entirely.

In a further development of the invention, the servicing device or devices include means for cleaning the spinning units. In this connection, the starting point is the consideration that it is expedient, in order to obtain a favorable thread quality, to create the same conditions at all spinning stations before the open-end spinning machine is placed in operation, by cleaning all of the spinning units. Thereby, a uniform thread quality can be attained.

In a further embodiment of the invention, the means of the servicing device or devices are combined into several, independently operable functional groups. This makes it possible to render the total mode of operation more economical, inasmuch as the individual functional groups can operate simultaneously at various spinning units. In this connection, it is advantageous to divide the servicing device or devices into a functional group executing the cleaning of the spinning units and a functional group accomplishing the seizing, cutting to length, preparation, and return of the thread ends to the spinning rotors.

In a further development of the invention, the functional group executing the seizing, cutting, preparing, and introduction of the thread ends into the spinning rotors is part of a mobile piecing device provided with additionally activatable means for taking off the thread returned to a spinning rotor and preferably with means for taking over and/or controlling the drive mechanisms for the installations for the feeding of the sliver and for the take-off and windup of the spun thread. This makes it possible to further exploit the mobile servicing device in that it is used, during normal operation, as a mobile piecing apparatus which effects a monitoring of the operation.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIGS. 5 and 6 are schematic representations of a servicing device of the present invention in different operating stages; and FIG. 7 is a partial sectional view of a spinning unit of an open-end spinning machine prepared in accordance with this invention.

DETAILED DESCRIPTION OF THE DRAWINGS

Figure 1:
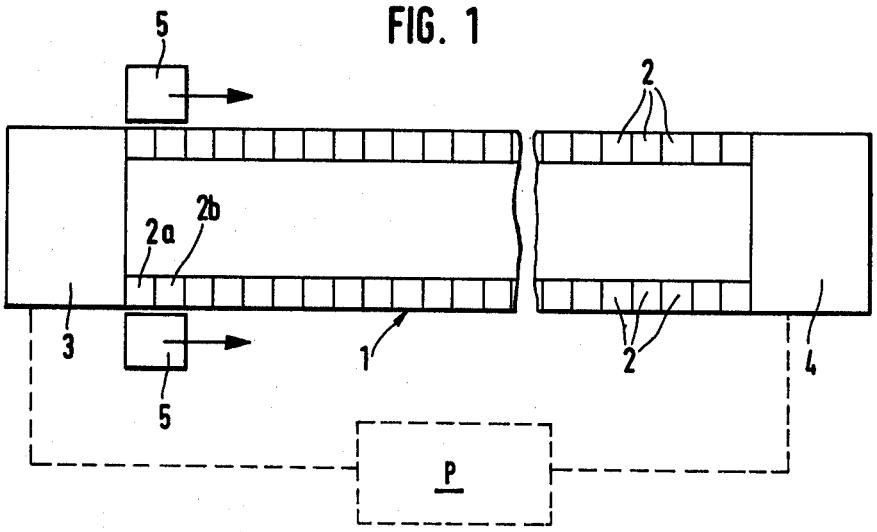
FIG. 1 is a top schematic view of an open-end spinning machine with two servicing devices constructed in accordance with an embodiment of the present invention.

In the embodiment of FIG. 1, a servicing device 5 for preparing the spinning units for a combined piecing operation is provided on each side for an open-end spinning machine 1 equipped on both sides with a plurality of spinning units 2 and at its head ends respectively with a central drive or transmission unit 3 and 4. These servicing devices are moveable along the open-end spinning machine 1 in the direction of the arrows. The servicing devices 5 are fashioned so that they are respectively associated simultaneously with two adjacent spinning stations 2*a, b*. The functional elements for conducting the necessary operating steps accommodated therein are subdivided into two groups which are operable independently and which execute successive process steps, as will be explained in greater detail hereinbelow.

Figure 2:
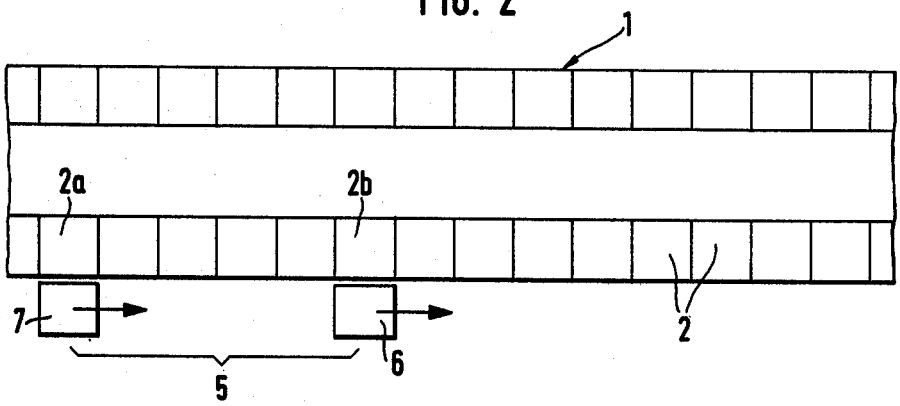
FIG. 2 is a top schematic view of an open-end spinning machine with a servicing device subdivided into two functional groups.

The open-end spinning machine 1 illustrated schematically in FIG. 2 likewise consists of many spinning units 2 arranged in a series. Along the open-end spinning machine 1, an independent servicing device 5 for preparing the combined piecing operation can be moved. This servicing device is made up of two component units 6, 7, which together prepare the machine for the piecing operation. The component unit 6 preferably prepares the respective spinning station and the component unit 7 preferably prepares the thread to be pieced. The division into two component units 6 and 7 has the advantage that the servicing device 5 can be utilized at the same time at mutually distant spinning units. It is also contemplated to move the component units 6 and 7 in synchronism, wherein also a mechanical coupling can be provided. The servicing device 5 moves, during the combined piecing operation, from one spinning unit to the next spinning unit and executes the preparative work.

Figure 3:
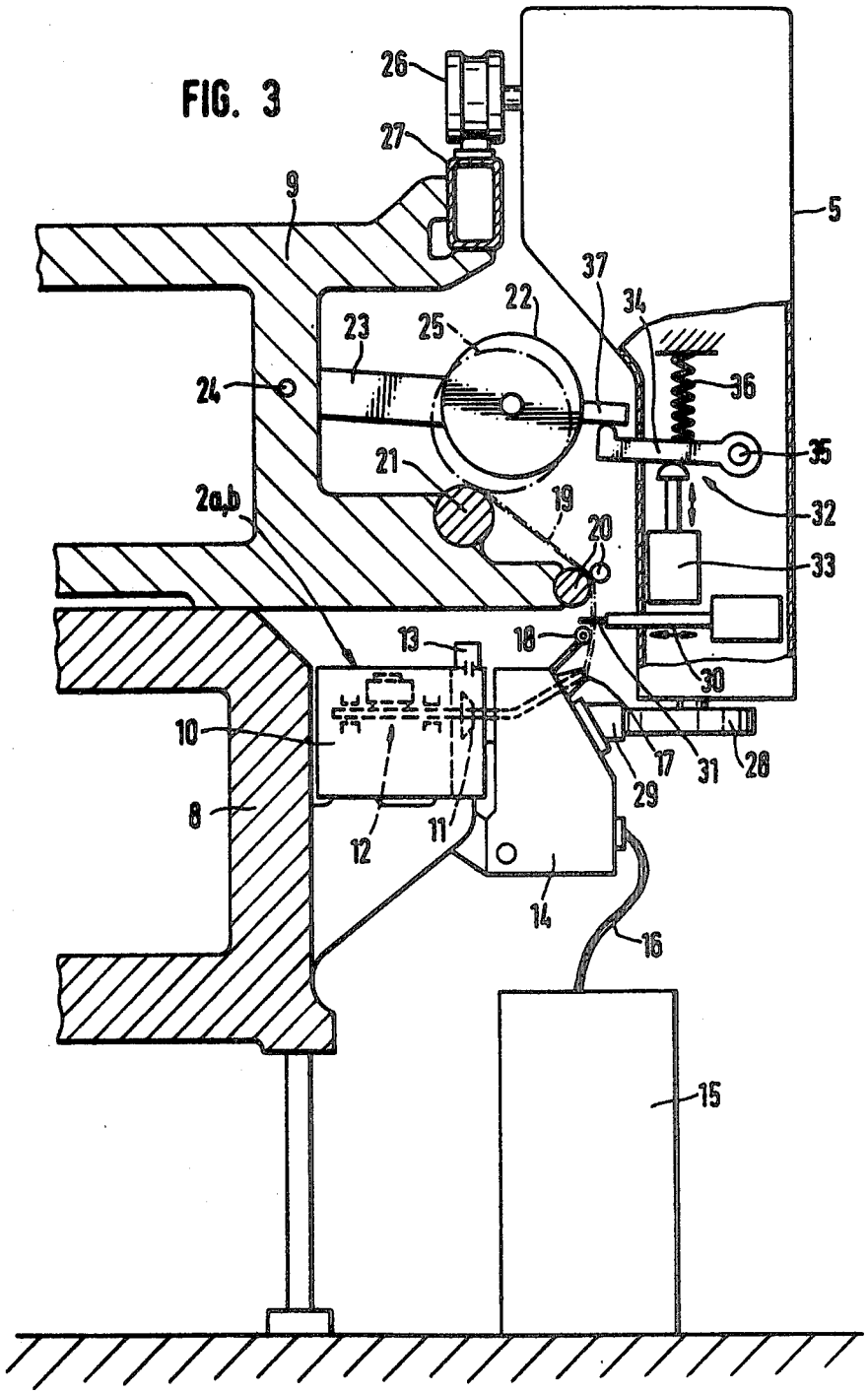
FIG. 3 is a vertical sectional view through one-half of an open-end spinning machine with a mobile servicing device constructed in accordance with the invention.

In FIG. 3, one-half of an open-end spinning machine 1 is illustrated in a sectional view; this maching being equipped on both sides with spinning units 2*a, b* arranged to mirror-image symmetry. The spinning units 2*a, b* are supported by a machine frame 8 which is continued in the upward direction in a further frame containing a spooling means. The spinning units 2*a, b* essentially comprise a housing 10 with a drive and bearing mechanism, denoted in total by 12, for a spinning turbine 11 and a housing 14 fashioned as a cover for a feeding and opening device. The feeding and opening device is supplied with sliver 16 withdrawn from a can 15, this sliver 16 being taken off as a spun thread 19 after the spinning operation by way of a thread take-off duct 17, the mouth of which is equipped with a thread break monitor 18. Take-off is effected by way of a pair of take-off rolls 20 followed by a bobbin or quill 22 which is driven by a winding roll (lap roller) 21 and can be lifted off about the axle 24 by means of a swivel arm 23. In the operating condition, the bobbin 22 assumes the position 25 shown in dot-dashed lines. At least one mobile servicing device 5 is provided for the open-end spinning machine 1, used for preparative work in connection with the later to be performed combined piecing operation. Each servicing device 5, which, according to preferred embodiments, can also consist of two component units 6, 7 travels with at least two runners 26 on a track 27 mounted above the bobbins 22 to the machine frame 9; this track extending continuously in the longitudinal direction of the open-end spinning machine 1. At least one of these runners 26, preferably profiled for the absorption of horizontal guide forces, is provided with a drive mechanism, not shown. A second support for the servicing device 5 is provided by way of at least one runner 28 arranged to be rotatable about a vertical axis and serving for the absorption of horizontal forces. This runner 28 is associated with a track 29 mounted to the open-end spinning machine 1.

The servicing device 5 comprises a thread severing means 30 capable of orienting a cutting means 31 to the course of the thread 19 in the direction of the double arrow, after the open-end spinning machine 1 has been shut off. The severed thread end still projecting from the thread take-off duct 17 can then be removed by the vacuum in the spinning turbine 11, which is connected to a vacuum duct 13, by means of suction. It is also contemplated by other embodiments of the inventon to cut off the vacuum as well when the machine is turned off, and to connect the vacuum duct 13 temporarily to the mobile servicing device 5, which device 5 will then contain means for the generation of a vacuum. The severed thread end 19, which is still connected to the bobbin 22, must thereafter be returned into the thread take-off duct 17, where it remains while the machine is turned off until the combined piecing operation is executed upon the initiation of the operation of the entire machine 1. For the return of the thread end, it is advantageous to lift the lap roller 22 off the drive roll 21. For this purpose, a lifting means 32 is provided which pivots, against the force of a spring 36, a swivel arm 34 about the axle 35 of the servicing device 5 which arm 34 in turn engages part 37 to pivot bobbin 22 about axis 24. A lifting piston magnet (piston-type solenoid) 33 serves as the actuating element 33. The return of the thread end 19 proper will be explained in greater detail below with reference to FIGS. 5 and 6.

Figure 4:
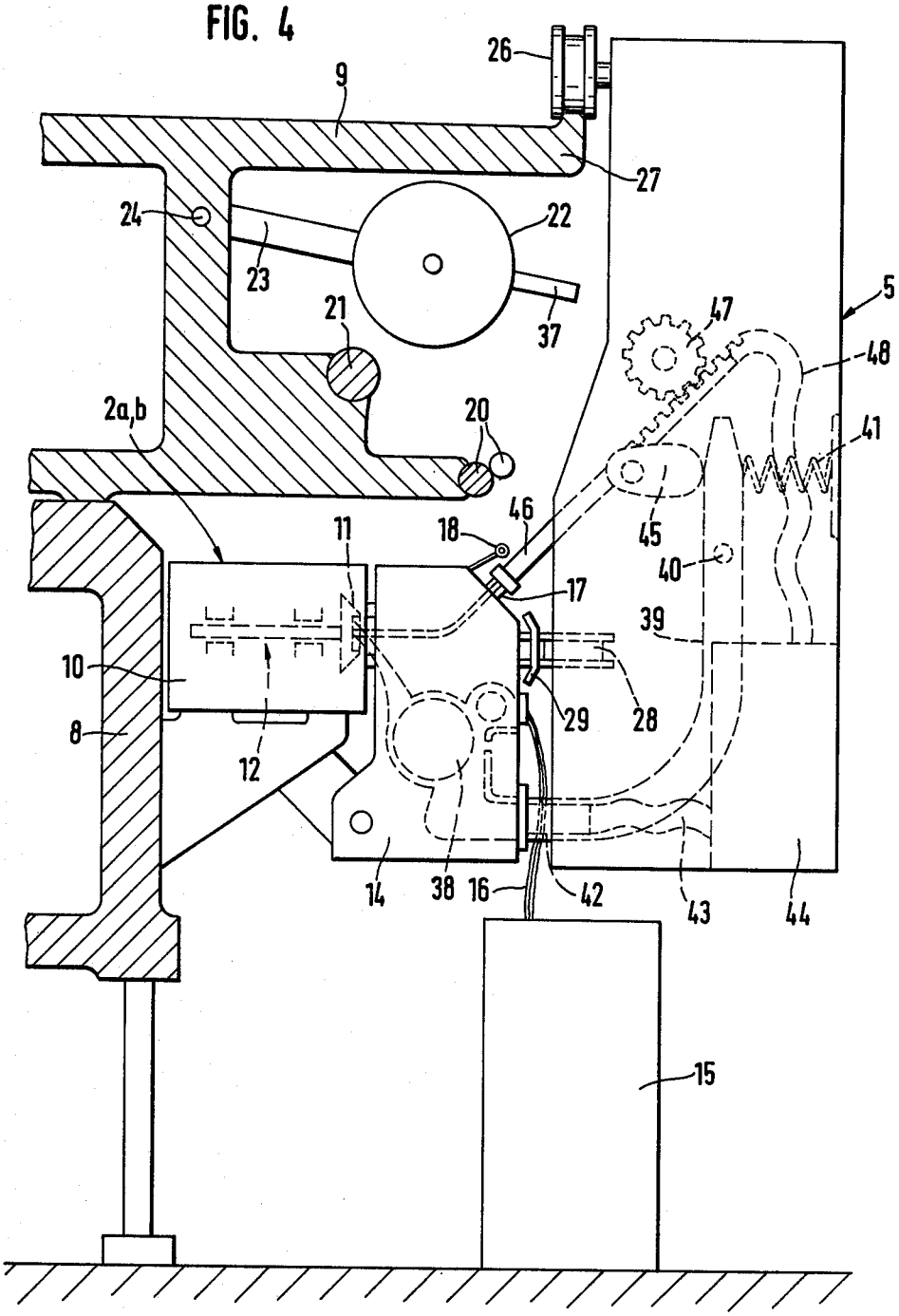
FIG. 4 is a sectional view similar to that of FIG. 3 and showing a mobile servicing device constructed in accordance with the invention and containing a different functional group.

After severing the thread 19, it is advantageous to clean the spinning unit by means of a cleaning device which is arranged in the servicing device 5 or in a separate installation. Such a cleaning device is shown schematically in FIG. 4. The servicing device 5 has an arm 39 pivotable about an axle 40 against the pressure of a spring 41. This arm is selectively connectible together with an extension piece 42, with the spinning unit. By means of a vacuum source connected to the servicing device 5, the opening roll 38 can be cleaned by conducting the dirt particles via the connecting pipe 42 and a preferably flexible conduit 43 into a dirt collecting chamber 44 arranged in the servicing device 5. The swivel arm 39 can be operated by a cam disk 45, if necessary, in a manner not shown in detail. Furthermore, a suction pipe 46 is provided which is fashioned, in part, as a rack drivingly associated together with a gear wheel 47 and connectible with the spinning unit. Also the suction pipe 46 is in communication with the dirt collecting chamber 44 by way of a flexible conduit 48. The suction pipe 46 serves for removing the dirt particles by suction from the arrested spinning rotor 11 by way of the thread take-off duct 17. It is to be noted expressly that the illustrated cleaning unit is to be understood only symbolically. Such a mobile cleaning unit in its greater details can be constructed utilizing this description and the state of the art.

Figure 5:
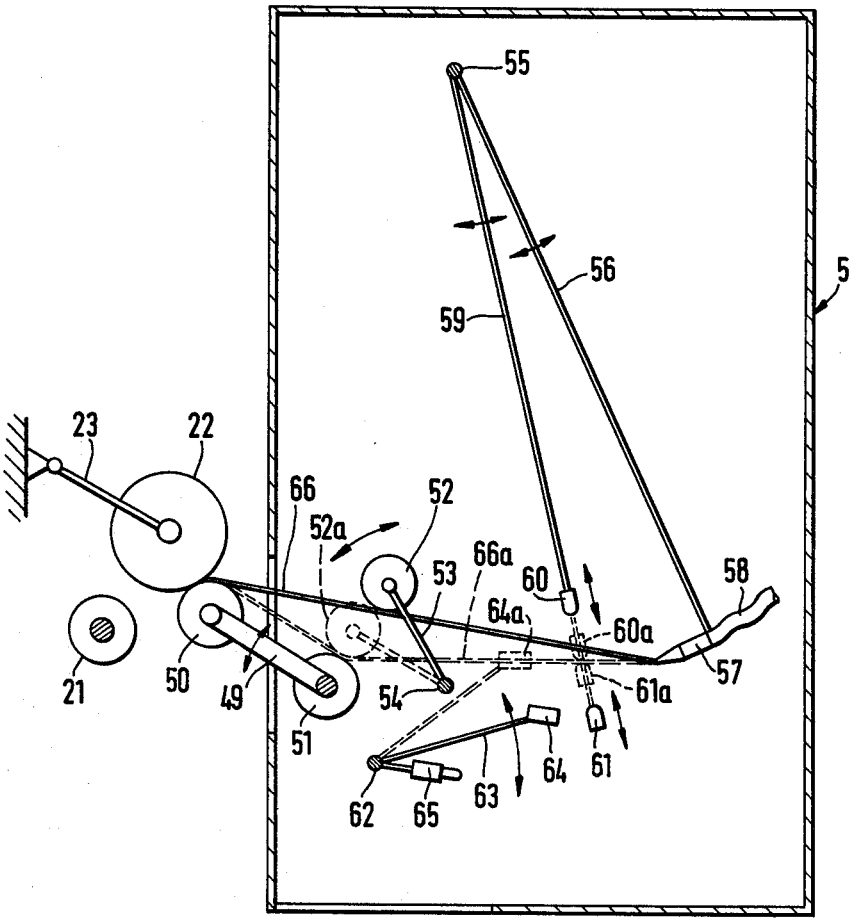
Figure 5:
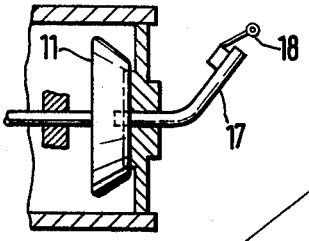

In FIG. 5, additional elements for the preparation for the piecing step are illustrated in the mobile servicing device 5 or in a separately movable component unit. The servicing device 5 comprises, first of all, a pivotable lever 49 carrying, on the one hand, a take-off roll 51 and, on the other hand, a lifting-off roller 50. The roll 51 and roller 50 are in a driving connection so that they run synchronously and can be driven in both directions of rotation. By means of the lifting-off roller 50, the bobbin 22 of the spinning unit is initially lifted off the driving roll 21. Furthermore, a swivel arm 56 is provided in the servicing device 5, this arm 56 being pivotable about an axis 55 in the direction of the double arrow. A suction nozzle 57 is connected to this swivel arm 56, this nozzle being connected by way of a flexible conduit 58 to a vacuum source, in a manner not shown herein. This suction nozzle 57 is selectively associatable with the windup bobbin 22, whereby the thread end, which had been severed in the manner described above, is sought with the aid of the vacuum and is then taken off. FIG. 5 shows the condition wherein the taken-off thread 66 extends from the bobbin 22 to the suction nozzle 57 in the illustrated position. It is advantageous for taking off the thread 66 to drive the lift-off roller 50 in the unwinding direction of the thread. The take-off roll 51 cooperates with a pressure roll 52, which can be lifted off and is initially in this lifted-off position with its swivel arm 53 in the illustrated representation. Furthermore, a thread gripper 60, 61 is provided which is arranged at a swivel arm 59 and which initially is not yet in engagement with the taken-off thread 66. The thread gripper 60 simultaneously serves as a means for opening the thread end 66 into a fiber tuft. The two parts of the thread gripper can be associated with the thread in the direction of the double arrows. See U.S. Pat. No. 3,925,975 of Stahleckeer et al for details of thread opening grippers.

After withdrawing the thread 66 from the windup bobbin 22, the thread is initally in a position as shown in full lines in FIG. 5. Subsequently, the pressure roll 52 is pivoted about the axle 54 toward the take-off roll 51, whereby the thread 66 is placed into the position **66*a* shown in dashed lines. The device 60 for opening up the thread end is shifted into the position 60*a*, 61*a*, by means of a drive mechanism, not shown, which system is set into rotations and the thread end 66*a* is cut off and freed of its spinning twist. The thread section present between the device 60*a*, 61*a* and the suction nozzle 57 is then removed by suction. Thus, a thread end 66*a* dissolved into a fiber tuft is produced which is seized by a transfer gripper 64 arranged at the lever 63. The transfer gripper 64 is pivotable in the direction of the double arrow about an axle 62 of the servicing device 5 and is associated with the thread end 66*a* (illustration 64*a* in dashed lines). Numeral 65 denotes a thread sensor which is placed in operation especially if the servicing device 5** is also designed to alternatively execute the piecing operation proper after a thread break during operation of the machine.

FIG. 6 shows the subsequent operating position of the servicing device 5. The transfer gripper 64 is now pivoted about the axle 62 and has aligned the thread end 66 within the thread take-off duct 17 of the spinning unit. With the aid of the driven take-off roll 51 of the servicing device 5 as well as with the help of the lifting-off roller 50, the thread end 66 can be further returned into the thread take-off duct 17; for the duration of this step, a vacuum is ambient in the spinning unit, so that the thread end is returned by suction. A thread break detector 18 arranged at the end of the thread take-off duct is thereby pressed into its operating position by means of the transfer gripper 64. After introducing the thread end 66, the thread is again transferred to the spinning station proper, as shown in FIG. 7. The actual piecing operation is not executed by the servicing device 5.

In order to produce the vacuum necessary for returning the thread end 66 into the zone of the spinning rotor 11, the drive mechanism of the vacuum-producing installation can remain in operation during the working time of the servicing device 5. However, it is also contemplated, in a manner not shown in detail, to provide the servicing device 5 with a suction nozzle mounted to an adjustable arm and being alignable with a corresponding connection of the housing surrounding the spinning rotor, so that the servicing device itself generates the vacuum necessary for taking in the thread end 66 (FIG. 6 schematically shows such a suction nozzle S). It is likewise contemplated to equip the transfer gripper 64 with a compressed-air nozzle, an injection nozzle, which can blow the thread end into the zone of the spinning rotor 11 by way of the thread take-off duct 17 (Such an injection nozzle N is schematically shown in dashed lines in FIG. 6).

During the return of the thread into the spinning rotor 11, the thread is suitably transferred by the servicing device 5 to the spinning unit, so that it is inserted in the position indicated in FIG. 7. Once all of the spinning units have been prepared accordingly, i.e. a thread end has been extended in the zone of each spinning unit from the bobbin 22 to the spinning rotor 11, the open-end spinning machine is ready for a combined (collective) piecing operation. The startup of the open-end spinning machine to execute this combined piecing step is conducted in accordance with a predetermined program. The spinning machine is equipped with a main switch which initiates, upon actuation, a program control apparatus which contains, for example, a mechanical or electronic stepping switch mechanism (FIG. 1 schematically shows such a program control apparatus P. Details of such a program control apparatus can be derived from the following description of desired operation, given the state of the art as exemplified by U.S. Pat. No. 3,987,610 to Stahlecker et al. This program control determines the instant at which the drive mechanisms of the indivdual devices are started up. This program control determines that first of all the drive of the device for producing a vacuum in the housings surrounding the spinning rotors 11 and the drive of the opening devices are placed in operation. Preferably, opening rolls are utilized as the opening devices, provided along their peripheries with a set of needles or teeth or the like. The many straps or belts are driven by continuous shafts or also by way of continuous bands. To these opening rolls is offered, at each spinning unit, a sliver in the form of a fiber tuft by means of a feeding device consisting preferably of a feed roll and a feeding table pressed against the former by spring force. Since a very important factor during the piecing operation is that all conditions are kept maximally exactly uniform, care should also be taken that the configuration and size of the fiber ruft offered to the opening device by the feeding device is identical with each piecing step at a spinning unit and also among the various spinning units. In general, the shape of the fiber tuft depends on how long the respective spinning unit has been arrested with the opening device still in operation, since the fiber tuft is more or less combed out, depending on this aspect. In order to fashion the fiber tufts to be uniform at all spinning units, it is advantageous for the program to provide that the drive mechanism of the device for feeding the sliver is turned on for a brief period of time after the drive mechanisms for the devices for producing the vacuum and for the opening device have already been turned on. If a short-term initiation and subsequent deactivation are conducted, then uniform and identical-size fiber tufts are produced at all spinning units. The fibers conveyed to the spinning rotor 11 during this procedure are again sucked out of the spinning rotor, since the rotor is still arrested.

After these steps, the program control provides that the drive mechanisms of the spinning rotor and of the silver feeding device are turned on. Since the spinning rotor requires a longer time to accelerate to its operating speed, a chronological staggering of the sliver feed is advantageously effected; i.e. the feed mechanism is turned on with some delay or also intermittently. Subsequently, the drive mechanisms of the devices are turned on, by means of which the thread is pulled out of the spinning rotor and would to the cop 22 on the bobbin. In this connection, the chronological synchronization is suitably conducted so that the thread end is already taken off from the fiber ring within the spinning rotor before the latter has reached its operating speed. Thereby, the piecing step can be accomplished also in a very safe fashion even in case of relatively high operating speeds of the spinning rotor.

The aforedescribed synchronization of the fiber tufts at the individual spinning units can also be effected during the turning off of the spinning machine, so that the time for the combined piecing operation can be shortened. In this case, the provision would have to be made to turn on, for a brief period of time, the sliver feed mechanism at all spinning units of the open-end spinning machine prior to the final shutting off step, while the opening device and the vacuum-producing device are likewise still in operation.

As shown in FIGS. 5–7, each spinning unit is provided with a thread monitor [thread break detector] 18 in the zone of the thread take-off duct 17. This thread monitor has the task of arresting the sliver feeding mechanism at each individual spinning unit if a thread break occurs. This can be achieved by opening an electromagnetic clutch or by clamping the sliver to be fed into position, or the like. In order to be able to conduct the combined piecing operation, switching elements are arranged which eliminate the function of the thread monitors 18 of the individual spinning units during the piecing operation; i.e. which take care that, independently of the thread monitors 18, the sliver feed is turned on at all spinning units. For this purpose, electromagnetic adjusting means are mounted to each spinning unit, for example, which place the thread monitors 18 of each spinning unit into the operative position during the startup with the program control, so that the sliver feed is simultaneously initiated in all spinning units. This positive placement of the thread monitors into the operating position can be maintained for a predetermined period of time, for example for a period of 10 seconds. Thereafter, the thread monitors are released again. If the piecing operation at the individual spinning units was successful, the thread monitor 18 is then held in the operating position by the traveling thread. If the piecing operation was unsuccessful, and no thread is present, then the thread monitor 18 can turn off the respective device for feeding the sliver.

As shown in FIG. 7, the thread end is returned into the spinning rotor by the preparative work to such an extend that it projects into the zone of a fiber-collecting groove. Under practical conditions, it will be expedient in many cases to conduct this return to the fiber-collecting groove only when the piecing step is being executed, i.e. when the feeding mechanism is also already in operation and a fiber ring is being formed. The return can then be effected by opening a thread reserve which is produced by the servicing device 5 during the transfer of the thread to the respective spinning unit. For this purpose, a centrally adjustable bar or the like could be mounted to the open-end spinning machine, effecting a deflection of the thread with respect to the normal thread course (FIG. 7), which deflection can be initiated simultaneously at all spinning units for piecing purposes by moving the bar away.

The servicing device 5 shown schematically in FIGS. 5 and 6 and explained in this description can be part of a mobile piecing apparatus with its functional elements. This mobile piecing apparatus intended for monitoring the operation and executing, after a thread has broken, automatically a piecing step at the respective spinning unit, suitably after a preceding cleaning operation requires in principal, for fulfilling its function, merely additionally the thread monitor sensor 65 which controls the driving direction of the take-off roll 51 and the auxiliary windup roll 50, as soon as the thread has been attached to a fiber ring deposited within the spinning rotor 11 and a sufficient thread tension has been produced. Suitably, the servicing device 5 is then furthermore equipped with auxiliary means which take over, for the piecing operation, either the driving action proper for the sliver feeding unit or which affect, by adjusting the thread monitor 18, the drive of the sliver feed so that it is in a favorable relationship with respect to the piecing speed which advantageously is lower as compared to the operating speed. These functional elements necessary for executing the piecing step during the monitoring of the operation are unnecessary when the servicing device conducts its work for preparing the spinning units for a combined piecing operation. Therefore, the provision is made advantageously to adjust the program of the servicing device 5 by means of a switch or the like so that the servicing device executes respectively one or the other of these servicing operations.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Open-end spinning machine apparatus comprising:
a plurality of spinning units with centrally controlled drive mechanisms,
piecing program control means for controlling starting-up of said drive mechanisms to effectuate simultaneous thread-piecing operations at said spinning units,
and piecing preparation apparatus for sequentially preparing a plurality of said spinning units for the piecing operations, said piecing preparation apparatus being movable sequentially to a plurality of the individual spinning units and being equipped with thread seizing means and thread returning means for seizing and returning thread ends to respective spinning rotors of the spinning units.

2. Apparatus according to claim 1, wherein said spinning units include the following devices driven by said drive mechanisms:
spinning rotors for spinning thread,
sliver feeding devices for feeding sliver to the spinning rotors,
sliver opening devices downstream of the sliver feeding means for opening the sliver supply to the spinning rotors,
spun thread take-off and winding devices for taking off spun thread from said rotors and winding same on bobbins,
and vacuum producing means for producing a vacuum in housings for said spinning rotors.

3. Apparatus according to claim 2, wherein said piecing preparation apparatus includes:
thread receiving means for receiving the thread ends from the bobbin associated with the particular spinning unit being prepared and for retracting a suitable length of thread from the bobbin.

4. Apparatus according to claim 1, wherein said piecing preparation apparatus includes:
thread cutting means for cutting the threads to a predetermined length,
and thread end preparing means for preparing the thread ends.

5. Apparatus according to claim 3, wherein said piecing preparation apparatus includes:
thread cutting means for cutting the threads to a predetermined length,
and thread end preparing means for preparing the thread ends.

6. Apparatus according to claim 1, wherein said piecing preparation apparatus includes:
thread feeding means for feeding the thread ends to thread take-off ducts of the spinning units.

7. Apparatus according to claim 5, wherein said piecing preparation apparatus includes:
thread feeding means for feeding the thread ends to thread take-off ducts of the spinning units.

8. Apparatus according to claim 6, wherein said thread feeding means includes:
a suction nozzle,
and suction nozzle connection means for connecting said suction nozzle to apply a vacuum to housings for spinning rotors of said spinning units.

9. Apparatus according to claim 7, wherein said thread feeding means includes:
a suction nozzle,
and suction nozzle connection means for connecting said suction nozzle to apply a vacuum to housings for spinning rotors of said spinning units.

10. Apparatus according to claim 6, wherein said thread feeding means includes:
an injection nozzle for injecting air,
and injection nozzle alignment means for aligning said injection nozzle with thread take-off ducts of said spinning units to blow thread ends through said ducts to rotors of the spinning units.

11. Apparatus according to claim 1, wherein said piecing preparation apparatus includes cleaning means for cleaning the spinning units.

12. Apparatus according to claim 7, wherein said piecing preparation apparatus includes cleaning means for cleaning the spinning units.

13. Apparatus according to claim 11, wherein said piecing preparation apparatus includes a plurality of independently operable functional groups for carrying out various steps of the piecing preparation process.

14. Apparatus according to claim 13, wherein the functional groups are accommodated in respective separately moveable component units, said component units being separately sequentially moveable to the spinning units.

15. Apparatus according to claim 13, wherein said functional groups include:

a first functional group for conducting cleaning of the spinning units, and a second functional group including the thread seizing means, the thread returning means, thread cutting means for cutting the thread to a predetermined length, and thread end preparing means for preparing the thread ends.

16. Apparatus according to claim 15, wherein the functional groups are accommodated in respective separately moveable component units, said component units being separately sequentially moveable to the spinning units.

17. Apparatus according to claim 15, wherein the second functional group is part of a mobile piecing apparatus which is also equipped with additional actuable means for performing a piecing operation at a spinning unit on an operating spinning machine; said additional actuable means including:

thread take-off means for taking off thread that has been returned to a spinning rotor and pieced with fibers therein, and spinning unit control means for controlling drive mechanisms for feeding sliver to spinning rotors of the spinning units and for the taking off and winding up of spun threads.

18. Apparatus according to claim 1, wherein said piecing preparation apparatus is also equipped with additional actuable means for performing a piecing operation at a spinning unit on an operating spinning machine; said additional actuable means including:

thread take-off means for taking off thread that has been returned to a spinning rotor and pieced with fibers therein, and spinning unit control means for controlling drive mechanisms for feeding sliver to spinning rotors of the spinning units and for the taking off and winding up of spun threads.

19. Apparatus according to claim 1, wherein each spinning unit is equipped with a thread monitor for monitoring the presence of a thread, this thread monitor including means for cutting off a sliver feeding device for the spinning unit when the thread is missing; and wherein additional centrally controlled switching elements are provided for intentionally turning on the sliver feeding devices at all of the spinning units, whereby the simultaneous start-up and piecing at the plurality of spinning units can be conducted without said monitor cutting off the sliver feeding devices.

20. Apparatus according to claim 18, wherein each spinning unit is equipped with a thread monitor for monitoring the presence of a thread, this thread monitor including means for cutting off a sliver feeding device for the spinning unit when the thread is missing; and wherein additional centrally controlled switching elements are provided for intentionally turning on the sliver feeding devices at all of the spinning units, whereby the simultaneous start-up and piecing at the plurality of spinning units can be conducted without said monitor cutting off the sliver feeding devices.

21. Apparatus according to claim 9, wherein each spinning unit is equipped with a thread monitor for monitoring the presence of a thread, this thread monitor including means for cutting off a sliver feeding device for the spinning unit when the thread is missing; and wherein additional centrally controlled switching elements are provided for intentionally turning on the sliver feeding devices at all of the spinning units, whereby the simultaneous start-up and piecing at the plurality of spinning units can be conducted without said monitor cutting off the sliver feeding devices.

22. A method for performing simultaneous automated piecing operations at a plurality of open-end spinning units with centrally controlled drive mechanisms, comprising:

sequentially preparing a plurality of said spinning units for piecing operations utilizing automated mobile piecing preparation apparatus which is movable sequentially to the individual spinning units, said mobile piecing preparation apparatus being equipped with thread seizing means and thread returning means for seizing and returning thread ends to respective spinning rotors of the spinning units, and controlling said drive mechanisms to effectuate starting up of said drive mechanisms and simultaneous thread piecing operations at said spinning units.

23. A method according to claim 22, wherein said spinning units include the following devices driven by said drive mechanisms:

spinning rotors for spinning thread, sliver feeding devices for feeding sliver to the spinning rotors, sliver opening devices downstream of the sliver feeding means for opening the sliver supply to the spinning rotors, spun thread take-off and winding devices for taking off spun thread from said rotors and winding same on bobbins, and vacuum producing means for producing a vacuum in housings for said spinning rotors.

24. A method according to claim 22, wherein said sequentially preparing includes receiving thread ends from bobbins associated with the particular spinning units being prepared and retracting of a suitable length of thread from the respective bobbin utilizing thread receiving means carried by said mobile piecing preparation apparatus.

25. A method according to claim 24, wherein said sequentially preparing includes cutting the thread ends to a predetermined length utilizing cutting means carried by said mobile piecing apparatus and preparing the thread ends for piecing utilizing thread end preparing means carried by said mobile piecing preparation apparatus.

26. A method according to claim 25, wherein said sequentially preparing includes feeding the thread ends to thread take-off ducts of the spinning units utilizing thread feeding means carried by said mobile piecing preparation apparatus.

27. A method according to claim 24, wherein said sequentially preparing includes feeding the thread ends to thread take-off ducts of the spinning units utilizing thread feeding means carried by said mobile piecing preparation apparatus and; wherein said thread feeding means includes:

a suction nozzle, and suction nozzle connection means for connecting said suction nozzle to apply a vacuum to housings for spinning rotors of said spinning units.

28. A method according to claim 26, wherein said thread feeding means includes:

a suction nozzle, and suction nozzle connection means for connecting said suction nozzle to apply a vacuum to housings for spinning rotors of said spinning units.

29. A method according to claim 22, wherein said sequentially preparing includes cleaning the spinning units utilizing cleaning means carried by the mobile piecing preparation apparatus.

30. A method according to claim 22, wherein said piecing preparation apparatus includes a plurality of independently operable functional groups for carrying out various steps of the piecing preparation process.

31. A method according to claim 30, wherein said functional groups include:

a first functional group for conducting cleaning of the spinning units, and a second functional group including the thread seizing means, the thread returning means, thread cutting means for cutting the thread to a predetermined length, and thread and preparing means for preparing the thread ends.

32. A method according to claim 31, wherein the second functional group is part of a mobile piecing apparatus which is also equipped with additional actuable means for performing a piecing operation at a spinning unit on an operating spinning machine; said additional actuable means including:

thread take-off means for taking off thread that has been returned to a spinning rotor and pieced with fibers therein, and spinning unit control means for controlling drive mechanisms for feeding sliver to spinning rotors of the spinning units and for taking off and winding up of spun threads.

33. A method according to claim 22, wherein each spinning unit is equipped with a thread monitor for monitoring the presence of a thread, this thread monitor including means for cutting off a sliver feeding device for the spinning unit when the thread is missing; and wherein additional centrally controlled switching elements are provided for intentionally turning on the sliver feeding devices at all of the spinning units, whereby the simultaneous start-up and piecing at the plurality of spinning units can be conducted without said monitor cutting off the sliver feeding devices.

* * * * *